US008173229B2

(12) United States Patent
Aoto

(10) Patent No.: US 8,173,229 B2
(45) Date of Patent: May 8, 2012

(54) INTERMEDIATE TRANSFER MEDIUM, AND IMAGE FORMING APPARATUS USING THE INTERMEDIATE TRANSFER MEDIUM

(75) Inventor: Jun Aoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 607 days.

(21) Appl. No.: 12/388,136
n

(22) Filed: Feb. 18, 2009

(65) Prior Publication Data

US 2009/0208258 A1 Aug. 20, 2009

(30) Foreign Application Priority Data

Feb. 18, 2008 (JP) ..... 2008-035519
Nov. 13, 2008 (JP) ..... 2008-290989

(51) Int. Cl.
*B41M 5/40* (2006.01)

(52) U.S. Cl. ..... 428/32.51; 428/206; 428/327; 428/413; 428/447; 428/473.5

(58) Field of Classification Search ..... 428/32.51, 428/206, 327, 413, 447, 473.5; 399/308
See application file for complete search history.

(56) References Cited

U.S. PATENT DOCUMENTS 4,788,570 A * 11/1988 Ogata et al. ..... 399/283
5,262,259 A * 11/1993 Chou et al. ..... 430/45.2
2007/0065607 A1* 3/2007 Kurachi et al. ..... 428/32.51

FOREIGN PATENT DOCUMENTS

JP 2001-100545 4/2001
JP 2001-125388 5/2001
JP 2004-354716 12/2004
JP 2005-266793 9/2005
JP 2006-285048 10/2006

* cited by examiner

*Primary Examiner* — Betelhem Shewareged
(74) *Attorney, Agent, or Firm* — Cooper & Dunham LLP

(57) ABSTRACT

An intermediate transfer belt, which receives plural color toner images from one or more image bearing members and then transfers the plural color toner images onto a receiving material. The intermediate transfer belt includes a substrate; and an outermost layer located overlying the substrate and including an epoxy-silicone copolymer. An image forming apparatus including at least one image bearing member configured to bear plural color toner images thereon; a primary transfer device including the intermediate transfer belt, wherein the primary transfer device transfers the plural color toner images from the at least one image bearing member to the intermediate transfer belt to form a combined color toner image thereon; and a secondary transfer device configured to transfer the combined color toner image onto a receiving material.

9 Claims, 2 Drawing Sheets

INTERMEDIATE TRANSFER MEDIUM, AND IMAGE FORMING APPARATUS USING THE INTERMEDIATE TRANSFER MEDIUM

BACKGROUND OF THE INVENTION

1. Field of the Invention

The present invention relates to an intermediate transfer medium for use in electrophotographic image forming apparatus. In addition, the present invention also relates to an electrophotographic image forming apparatus using the intermediate transfer medium.

2. Discussion of the Related Art

Electrophotographic image forming apparatus include various seamless belt members such as fixing belts, image transfer belts and receiving material feeding belts. Among the electrophotographic image forming apparatus, full color image forming apparatus typically use an intermediate transfer belt, which receives four color toner images formed on one or more photoreceptors to form a combined color toner image thereon and then transfers the combined image to a receiving material to form a full color image thereon. Demand for such intermediate transfer belts rapidly increases as demand for full color image forming apparatus increases.

Thermoplastic resins, thermosetting resins, rubbers and elastomers are typically used for such intermediate transfer belts.

On the other hand, tandem image forming apparatus, in which four image forming units each including at least a photoreceptor, a charger, and a developing device are serially arranged so as to be opposed to an intermediate transfer belt, have been typically used for full color image forming apparatus to perform high speed color image formation. Such intermediate transfer belts are required to have the following properties:

(1) The belts are not deformed during an image forming operation to prevent occurrence of a color misalignment problem in that one or more of color toner images are not transferred to the predetermined positions of the intermediate transfer belt, namely, the intermediate transfer belt is required to have a high mechanical strength sufficient for enduring mechanical stresses over a long period of time; and (2) The belts have good flame resistance.

Therefore, polyimide resins, and polyamideimide resins are typically used for such intermediate transfer belts. Particularly, polyimide resins are preferably used because of having a good combination of creep resistance and durability.

Since polyimide resins have a high mechanical strength, intermediate transfer belts made of such polyimide resins typically have a high surface hardness. Therefore, a toner image present on a polyimide intermediate transfer belt receives a high pressure in a transfer process, thereby often causing an image omission problem in that the toner particles forming the toner image aggregate due to the high pressure applied thereto, and part of the toner image is not transferred. In addition, polyimide intermediate transfer belts have a poor contact property (i.e., poor cushionability). Therefore, when a toner image is transferred from a photoreceptor to a polyimide intermediate transfer belt or from the intermediate transfer belt to a receiving material, the intermediate transfer belt tends to be unevenly contacted with the photoreceptor or the receiving material at the image transfer positions. In this case, an uneven image transfer problem is easily caused.

Recently, various image receiving materials are used for electrophotographic image forming apparatus. Specifically, not only plain papers having smooth surface, but also coated papers having high slip property and high smoothness, and papers having rough surface such as recycled papers, embossed papers, Japan papers and craft papers are used as receiving materials. In order to well transfer toner images onto such various papers, the intermediate transfer belt has to have a good cushionability. When an intermediate transfer belt having a poor cushionability is used, uneven density images and uneven color-tone images are produced.

In attempting to impart a good cushionability to an intermediate transfer belt, a technique in that a relatively flexible outermost layer is formed thereon is proposed.

Published unexamined Japanese patent application No. (hereinafter referred to as JP-A) 2001-100545 discloses an intermediate transfer belt in which an elastic layer is formed on a substrate, wherein the ratio of the thickness of the elastic layer and the thickness of the substrate is specified to prevent occurrence of the above-mentioned image omission problem. When a relatively thick elastic layer is formed on a substrate to impart good cushionability to the resultant belt, the substrate has to be also relatively thick, and therefore polyimide resins, which typically have a large elastic modulus, cannot be used as the substrate. Therefore, the intermediate transfer belt has poor creep resistance and durability.

JP-A 2001-125388 discloses a multilayer intermediate transfer belt, in which the volume resistivities of the substrate and the outermost layer are specified and the water absorption rate of the outermost layer is specified, to stabilize the volume resistivity of the belt even when environmental conditions change. However, the materials used for the intermediate transfer belt are popular materials and are not special materials. In addition, other properties of the belt are not explained therein.

JP-A 2004-354716 discloses an intermediate transfer belt in which a binder layer having a smaller elastic modulus than that of the substrate is formed on the substrate, and in addition a particulate material is adhered to the surface of the binder layer to impart a good combination of transferability and durability to the belt without deteriorating the flexibility of the belt. Although the particle diameter of the filler is specified, it is difficult to control the state of the thus adhered filler. In addition, since such a filler is easily abraded, the intermediate transfer belt has poor durability.

JP-A 2005-266793 discloses an intermediate transfer belt in which a thermosetting resin layer having a melting pint of not higher than 300° C. is formed on a thermoplastic resin substrate while hardened using a hardener. It is described therein that by forming an intermediate layer having elasticity is formed, the resultant intermediate transfer belt can be contacted with a photoreceptor or a receiving material while having a wide contact area, and thereby good image transfer efficiency can be imparted to the intermediate transfer belt. However, the thermosetting resin layer is formed to improve the scratch resistance of the belt, resulting in prevention of deterioration of glossiness of images. Therefore, the invention is different from the present invention. In addition, since a thermoplastic resin is used for the substrate, the substrate tends to easily deform or change the resistivity thereof when the thermosetting resin layer is hardened. Thus, the intermediate transfer belt has poor production stability.

JP-A 2006-285048 discloses an intermediate transfer belt in which an outermost layer including a hardened material of a liquid silicone rubber and carbon black is formed on a substrate made of a material such as polyimides and polyamideimides. It is described therein that the outermost layer has a good combination of releasability, elasticity and surface property. However, since silicone rubbers have poor adhesion to polyimides, an adhesive layer has to be formed between the outermost layer and the substrate. In addition, since carbon black is not well dispersed in silicone rubbers, the resultant intermediate transfer belt has uneven resistivity, resulting in occurrence of uneven image transfer. Therefore, the intermediate transfer belt has poor production stability.

Because of these reasons, a need exists for an intermediate transfer belt which has a good combination of creep resistance, dimension stability and durability and which can well transfer toner images onto various receiving materials having different surface properties, resulting in formation of high quality images without omissions and unevenness such as image density unevenness and color-tone unevenness.

SUMMARY OF THE INVENTION

Accordingly, an object of the present invention is to provide an intermediate transfer belt, which receives plural color toner images from one or more image bearing members (such as photoreceptors) and then transfers the plural color toner images onto a receiving material, wherein the intermediate transfer belt includes:

a substrate; and an outermost layer located overlying the substrate and including an epoxy-silicone copolymer.

In this regard, "overlying" can include direct contact and allow for one or more intermediate layers.

The substrate preferably includes a polyimide resin.

As another aspect of the present invention, an electrophotographic image forming apparatus is provided, which includes:

at least one image bearing member configured to bear plural color toner images thereon;

a primary transfer device including:

the intermediate transfer belt mentioned above, wherein the primary transfer device transfers the plural color toner images from the at least one image bearing member to the intermediate transfer belt to form a combined color toner image thereon; and a secondary transfer device configured to transfer the combined color toner image onto a receiving material.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
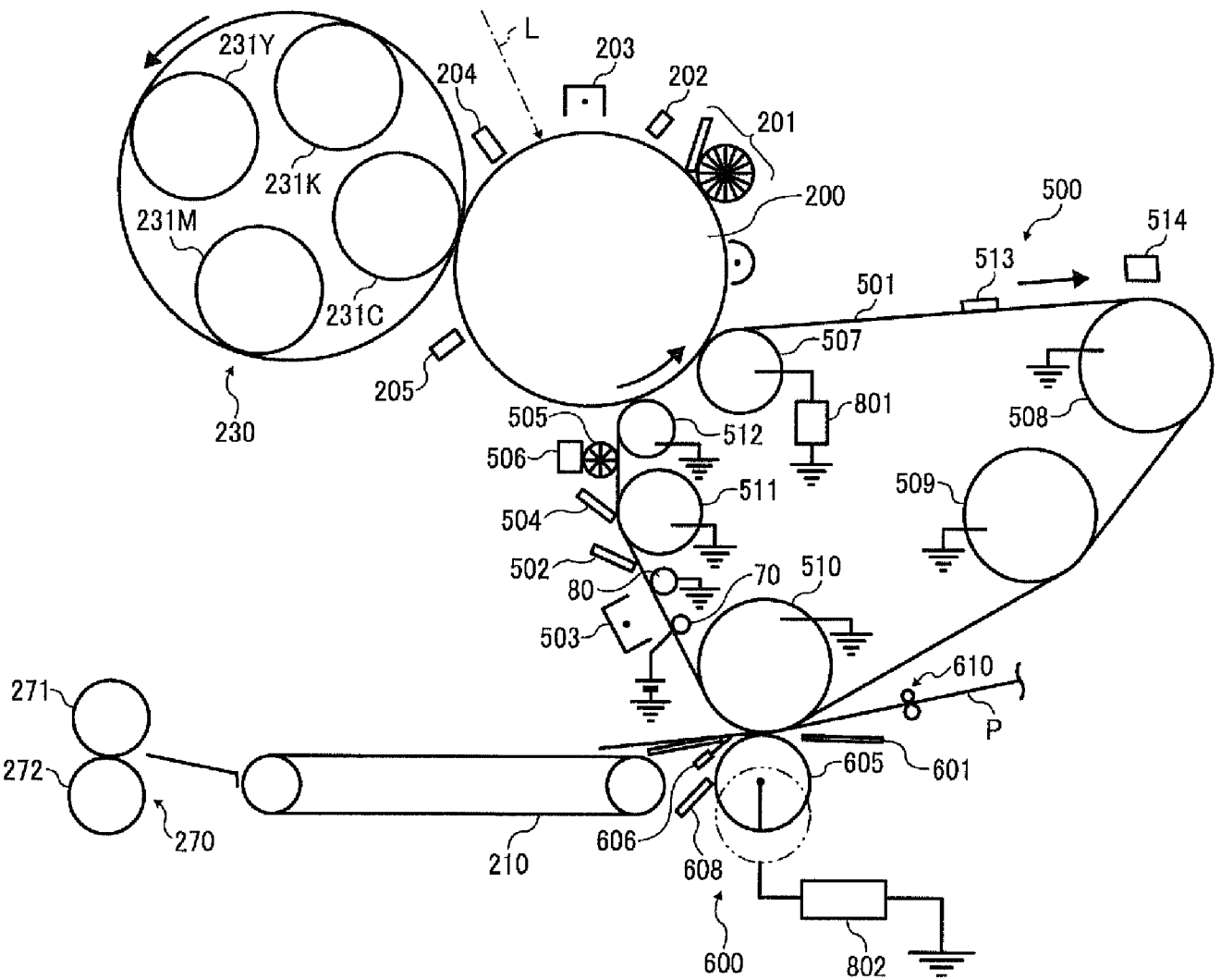
FIG. 1 is a schematic view illustrating an example of the electrophotographic image forming apparatus of the present invention.

Suitable resins for use in the substrate of the intermediate transfer belt (seamless belt) of the present invention include polyimide resins, polyamideimide resins, fluorine-containing resins, polycarbonate resins, polyarylate resins, polyethyleneterephthalate resins, polyphenylenesulfide resins, heat resistant polyamide resins, polyether ether ketone resins, etc. As mentioned above, recently a strong need exists for a high speed full color image forming apparatus capable of producing high quality color images, and therefore the intermediate transfer belts thereof are required to have a good combination of dimension stability and mechanical strength. Therefore, polyimide resins are preferably used for the intermediate transfer belt of the present invention.

Polyimide resins are broadly classified into thermoplastic polyimide resins, solvent-soluble polyimide resins and thermosetting polyimide resins. All of these polyimide resins can be used for the intermediate transfer belt of the present invention. However, since the intermediate transfer belt of the present invention includes other materials such as resistivity controlling agents, it is preferable to use a thermosetting polyimide resin, i.e., to coat a polar organic solvent solution of a polyimide precursor (i.e., a polyimide varnish) and then thermally crosslinking the coated resin precursor to form a polyimide layer.

Next, polyimide precursors for use in a coating liquid for forming the intermediate transfer belt of the present invention and heat treatment performed for the coated polyimide precursors will be explained.

<Polyimide>

Polyimide resins are generally prepared by reacting a polycarboxylic acid anhydride (typically an aromatic polycarboxylic acid anhydride) or its derivative with an aromatic diamine (i.e., condensation reaction). Because the main chain of the polyimide resins is rigid, polyimide resins are insoluble in solvents and are not melted by heat. Therefore, at first, an acid hydride and an aromatic diamine are reacted to synthesize a polyimide precursor (i.e., a polyamic acid or polyamide acid) which can be dissolved in an organic solvent. The thus prepared polyamic acid is subjected to molding, followed by dehydration/cyclization treatment (i.e., imidization (formation of a polyimide)) upon application of heat thereto or using a chemical method. The reaction process is as follows.

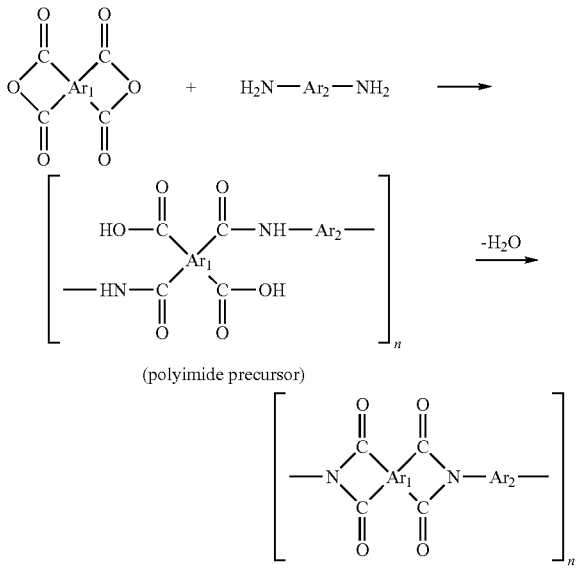

In the formula, $Ar_1$ represents a tetravalent aromatic group including at least one six-membered carbon ring; and $Ar_2$ represents a divalent aromatic group including at least one six-membered carbon ring.

Specific examples of the polycarboxylic acid anhydrides include ethylenetetracarboxylic acid dianhydride, cyclopentanetetracarboxylic acid dianhydride, pyromellitic acid dianhydride, 3,3',4,4'-benzophenonetetracarboxylic acid dianhydride, 2,2',3,3'-benzophenonetetracarboxylic acid dianydride, 3,3',4,4'-biphenyltetracarboxylic acid dianhydride, 2,2',3,3'-biphenyltetracarboxylic acid dianhydride, 2,2-bis(2,3-dicarboxyphenyl)propane dianhydride, bis(3,4-dicarboxyphenyl)ether dianhydride, bis(3,4-dicarboxyphenyl)sulfone dianhydride, 1,1-bis(2,3-dicarboxyphenyl) ethane dianhydride, bis(2,3-dicarboxyphenyl)methane dianhydride, bis(3,4-dicarboxyphenyl)methane dianhydride, 2,2-bis(3,4-dicarboxyphenyl)-1,1,1,3,3,3-hexafluoropropane dianhydride, 2,3,6,7-naphthalenetetracarboxylic acid dianhydride, 1,4,5,8-naphthalenetetracarboxylic acid dianhydride, 1,2,5,6-naphthalenetetracarboxylic acid dianhydride, 1,2,3,4-benzenetetracarboxylic acid dianhydride, 3,4,9,10-perylenetetracarboxylic acid dianhydride, 2,3,6,7-anthracenetetracarboxylic acid dianhydride, 1,2,7,8-phenanthreneteracarboxylic acid dianhydride, etc. These compounds can be used alone or in combination.

Specific examples of the aromatic diamine compounds to be reacted with polycarboxylic acid anhydride include m-phenylenediamine, o-phenylenediamine, p-phenylenediamine, m-aminohenzylamine, p-aminobenzylamine, 4,4'-diaminodiphenyl ether, 3,3'-diaminodiphenyl ether, 3,4'-diaminodiphenyl ether, bis(3-aminophenyl)sulfide, (3-aminophenyl)(4-aminophenyl)sulfide, bis(4-aminophenyl)sulfide, bis(3-aminophenyl)sulfide, (3-aminophenyl)(4-aminophenyl)sulfoxide, bis(3-aminophenyl)sulfone, (3-aminophenyl)(4-aminophenyl)sulfone, bis(4-aminophenyl) sulfone, 3,3'-diaminobenzophenone, 3,4'-diaminobenzophenone, 4,4'-diaminobenzophenone, 3,3'-diaminodiphenylmethane, 3,4'-diaminodiphenylmethane, 4,4'-diaminodiphenylmethane, bis[4-(3-aminophenoxy)phenyl]methane, bis[4-(4-aminophenoxy)phenyl]methane, 1,1-bis[4-(3-aminophenoxy)phenyl]ethane, 1,1-bis[4-(4-aminophenoxy)phenyl]ethane, 1,2-bis[4-(3-aminophenoxy) phenyl]ethane, 1,2-bis[4-(4-aminophenoxy)phenyl]ethane, 2,2-bis[4-(3-aminophenoxy)phenyl]propane, 2,2-bis[4-(4-aminophenoxy)phenyl]propane, 2,2-bis[4-(3-aminophenoxy)phenyl]butane, 2,2-bis[3-(3-aminophenoxy)phenyl]-1,1,1-3,3,3-hexafluoropropane, 2,2-bis[4-(4-aminophenoxy) phenyl]-1,1,1-3,3,3-hexafluoropropane, 1,3-bis(3-aminophenoxy)benzene, 1,3-bis(4-aminophenoxy)benzene, 1,4-bis(3-aminophenoxy)benzene, 1,4-bis(4-aminophenoxy)benzene, 4,4'-bis(3-aminophenoxy)biphenyl, 4,4'-bis (4-aminophenoxy)biphenyl, bis[4-(3-aminophenoxy)phenyl]ketone, bis[4-(4-aminophenoxy)phenyl]ketone, bis[4-(3-aminophenoxy)phenyl]sulfide, bis[4-(4-aminophenoxy) phenyl]sulfide, bis[4-(3-aminophenoxy)phenyl]sulfoxide, bis[4-(4-aminophenoxy)phenyl]sulfoxide, bis[4-(3-aminophenoxy)phenyl]sulfone, bis[4-(4-aminophenoxy)phenyl] sulfone, his[4-(3-aminophenoxy)phenyl]ether, bis[4-(4-aminophenoxy)phenyl]ether, 1,4-bis[4-(3-aminophenoxy) benzoyl]benzene, 1,3-bis[4-(3-aminophenoxy)benzoyl] benzene, 4,4'-bis[3-(4-aminophenoxy)benzoyl] diphenylether, 4,4'-bis[3-(3-aminophenoxy)benzoyl] diphenylether, 4,4'-bis[4-(4-amino-α,α-dimethylbenzyl) phenoxy]benzophenone, 4,4,-bis[4-(4-amino-α,α-dimethylbenzyl)phenoxy]diphenylsulfone, bis[4-{4-(4-aminophenoxy)phenoxy}phenyl]sulfone, 1,4-bis[4-{4-(4-aminophenoxy)phenoxy}-α,α-dimethylbenzyl]benzene, 1,3-bis[4-(4-aminophenoxy)-α,α-dimethylbenzyl]benzene, etc. These compounds are used alone or in combination.

By subjecting one or more of these polycarboxylic acid anhydride compounds and one or more diamine compounds, which are mixed in a molar ratio of about 1/1, to a polymerization reaction in a polar organic solvent, a polyimide precursor (i.e., polyamic acid) can be prepared.

Next, the method for preparing a polyimide resin precursor will be explained.

Suitable polar organic solvents for use in the polymerization reaction include sulfoxides such as dimethylsulfoxide and diethylsulfoxide; formamides such as N,N-dimethylformamide and N,N-diethylformamide; acetamides such as N,N-dimethylacetamide and N,N-diethylacetamide; pyrrolidone based solvents such as N-methyl-2-pyrrolidone N-vinyl-2-pyrrolidone; phenolic solvents such as phenol, o-, m- or p-cresol, xylenol, halogenated phenol and catechol; ethers such as tetrahydrofuran, dioxane and dioxolan; alcohols such as methanol, ethanol and butanol; cellosolves such as butyl cellosolve; hexamethylphosphoramide, γ-butyrolactone, etc. These solvent are used alone or in combination. Among these solvents, N,N-dimethylacetamide and N-methyl-2-pyrrolidone are preferably used.

One method for preparing a polyimide resin precursor is as follows. At first, in an inert gas (such as argon gas and nitrogen gas) environment, one or more diamines are dissolved in an organic solvent. Alternatively diamines may be dispersed in an organic solvent to form a slurry. When one or more polycarboxylic acid anhydrides or their derivatives, which may have a solid state, or a solution or a slurry state by being dissolved or dispersed in an organic solvent, are added thereto, a ring opening polymerization reaction accompanied with generation of heat is induced. In this case, the viscosity of the mixture rapidly increases, and a polyamic acid with a high molecular weight is produced. In this case, the reaction temperature is preferably from −20° C. to 100° C., and more preferably not higher than 60° C. The reaction time is preferably form 30 minutes to 12 hours.

The addition order of diamines and polycarboxylic acid anhydrides is not limited thereto, and it is possible to add one or more diamines (in a form of solid, solution or slurry) to one or more polycarboxylic acid dianhydrides (in a form of solution or slurry) or to mix the compounds in a container at the same time. In addition, it is possible to add one or more diamines and one or more polycarboxylic acid dianhydrides to a polar organic solvent at the same time to be reacted.

The molar ratio of the one or more diamines to the one or more polycarboxylic acid dianhydrides is preferably about 1/1.

By performing the above-mentioned reaction, a solution of a polyimide resin precursor in which the polyamic acid is uniformly dissolved in the polar organic solvent can be prepared.

Thus, a polyimide precursor solution (i.e., a polyamic acid solution) can be easily synthesized. However, polyamic acid solutions can be commercially available as polyimide varnishes. Specific examples of the marketed polyimide varnishes include TORENEES (from Toray Ltd.), U-VARNISH (from Ube Industries Ltd.), RIKACOAT (from New Japan Chemical Co., Ltd.), OPTOMER (from Japan Synthetic Rubber Co., Ltd.), SE812 (from Nissan Chemical Industries, Ltd.), CRC8000 (from Sumitomo Bakelite Co., Ltd.), etc.

The thus synthesized polyamic acid solution (or commercially available polyamic acid solution) is then mixed with optional additives to prepare a coating liquid. The coating liquid is coated on a substrate (or a die for molding), and the coated liquid is then subjected to a treatment such as heating. Thus, the polyamic acid (i.e., a polyimide precursor) is converted to a polyimide resin (i.e., an imidization reaction is performed).

The above-mentioned imidization reaction (i.e., conversion of a polyamic acid to a polyamide) is performed by (1) a heating method or (2) a chemical method.

In the heating method, the polyamic acid is heated at a temperature of from 200 to 300° C. to be converted to a polyimide resin. The heating method has an advantage in that a polyimide resin can be easily prepared. In the chemical method, the polyamic acid is reacted with a dehydration ring forming agent such as mixtures of a carboxylic acid anhydride and a tertiary amine, and then the reaction product is heated to prepare a polyimide resin. Thus, the chemical method is relatively complex compared to the heating method and therefore the manufacturing costs are relatively high. Accordingly, the heating method is popularly used.

However, modified chemical methods, in which an amine such as imidazole and quinoline is included in a polyimide varnish as a catalyst to accelerate the imidization reaction in the drying process, have also been used. In general, the imidization reaction has to be performed at a temperature higher than the glass transition temperature of the resultant polyimide resin in order to impart the desired properties (such as mechanical durability) to the resultant polyimide resin. However, by using the above-mentioned modified chemical methods, the imidization reaction can be completed at a relatively low temperature, and the mechanical durability of the resultant polyimide resin is improved. The added amount of such catalysts is preferably as small as possible. Among the catalysts, decomposing or sublimating catalysts are preferably used and catalysts, which tend to remain in the resultant polyimide resin, are not preferable.

The imidization rate (i.e., the degree of a polyamic acid converted to a polyimide resin) can be determined by any known methods which are used for measuring the imidization rate. Specific examples thereof are as follows.

(1) a nuclear magnetic resonance (NMR) method in which the imidization rate is determined on the basis of an integral ratio of 1H of the amide group observed at 9 to 11 ppm to 1H of the aromatic group observed at 6-9 ppm;

(2) a Fourier transfer infrared spectrophotometric method (i.e., FT-IR method);

(3) a method in which water generated by forming an imide ring is determined; and (4) a method in which the amount of residual carboxylic acid is determined by a neutralization titration method.

Among these methods, the FT-IR method is typically used. When the FT-IR method is used, the imidization rate is determined as follows.

$$\text{Imidization rate}=(Mia/Mii)\times 100$$

wherein Mia represents the number of moles of the imide group determined in the heating step (i.e., imidization step); and Mii represents the number of moles of the imide group which is calculated while assuming that the polyamic acid is perfectly changed to the polyimide resin.

The imidization rate can be determined by the absorbance ratio of the imide group to other groups. Specific examples of the absorbance ratio are as follows.

(1) a ratio of the absorbance of a peak at 725 $cm^{-1}$, which is caused by the bending vibration of the C═O group of the imide ring, to the absorbance of a peak at 1,015 $cm^{-1}$ which is specific to the benzene ring;

(2) a ratio of the absorbance of a peak at 1,380 $cm^{-1}$, which is caused by the bending vibration of the C—N group of the imide ring, to the absorbance of a peak at 1,500 $cm^{-1}$ which is specific to the benzene ring;

(3) a ratio of the absorbance of a peak at 1,720 $cm^{-1}$, which is caused by the bending vibration of the C═O group of the imide ring, to the absorbance of a peak at 1,500 $cm^{-1}$ which is specific to the benzene ring; and (4) a ratio of the absorbance of a peak at 1,720 $cm^{-1}$, which is specific to the C═O group of the imide ring, to the absorbance of a peak at 1,670 $cm^{-1}$ which is caused by the interaction of the bending vibration of the N—H group and the stretching vibration of the C—N group of the amide group.

In addition, if it is confirmed that the multiple absorption bands at 3000 to 3300 $cm^{-1}$, which are specific to the amide group, disappear, the reliability of completion of the imidization reaction is further enhanced.

Specific examples of the thermoplastic polyimide resins include AURUM from Mitsui Chemicals, Inc., and VESPEL from DuPont. Specific examples of the solvent-soluble polyimide resins include RIKACOAT from New Japan Chemical Co., Ltd., block polyimide copolymers from PI Research & Development Co.; and GPI from Gun Ei Chemical Industry Co., Ltd.

Not only polyimide resins but also combinations of a polyimide resin and another resin can be used for the substrate of the intermediate transfer belt of the present invention. In addition, the substrate can include other additives (such as resistivity controlling agents, leveling agents, surfactants, lubricants, antioxidants, and catalysts) for imparting necessary functions to the intermediate transfer belt. Among these additives, resistivity controlling agents are important additives.

Next, the resistivity controlling agent will be explained.

A resistivity controlling agent is preferably added in the intermediate transfer belt of the present invention to control the resistivity of the belt. Any materials which can control the resistivity of a polyimide resin can be used.

Specific examples of the materials include fillers such as carbon blacks, graphite, powders of metals (such as copper, tin, aluminum and indium); powders of metal oxides (such as tin oxides, zinc oxides, titanium oxides, indium oxides, antimony oxides, bismuth oxides, tin oxides which are subjected to antimony doping, and indium oxides which are subjected to tin doping); electroconductive polymers (such as polyether amide, polyether ester amide, polypyrrole, polythiophene, and polyaniline); ionic electroconductive materials (such as tetraalkylammonium salts, trialkylbenzylammonium salts, alkylsulfonic acid salts, alkylbenzenesulfonic acid salts, alkylsulfates, glycerin fatty acid esters, sorbitane fatty acid esters, polyoxyethylenealkyl amines, polyoxyethylene-aliphatic alcohol esters, alkylbetaine, lithium perchlorate, etc., but are not limited thereto. These materials can be used alone or in combination.

Among these materials, carbon black is preferably used as a resistivity controlling agent for the substrate of the intermediate transfer belt of the present invention. Specific examples of the carbon black include furnace black, acetylene black, KETJEN BLACK, channel black, etc. In addition, carbon blacks, whose surface is subjected to an oxidation treatment, are preferably used.

If desired, dispersing agents can be used in combination of carbon black. Alternatively, carbon black in which the functional groups present on the surface thereof are reacted with an organic material may be used instead of using a dispersing agent.

Next, the method for preparing a seamless belt using a coating liquid including a polyimide resin precursor. For example, the following method can be used.

The method includes the following processes:

(1) a dispersion preparation process in which a resistivity controlling agent is dispersed in a polyimide resin precursor solution (i.e., polyamic acid solution);

(2) a coating liquid preparation process in which the content of the resistivity controlling agent is adjusted so as to be a predetermined content;

(3) a coating liquid applying/spreading process in which the coating liquid is applied and spread on a support (i.e., a die for molding);

(4) a solvent removing process in which the coated liquid is heated to remove the solvent therefrom;

(5) an imidization process in which the dried coated layer is heated to convert the polyimide resin precursor (i.e., polyamic acid) to a polyimide resin; and (6) a removing process in which the polyimide resin film formed on the support is released from the support to prepare a seamless belt.

In the dispersion preparation process, the resistivity controlling agent can be added by a method in which the agent is directly added to the polyimide resin precursor solution to be dispersed therein, or a method in which at first the agent is dispersed in a solvent, and the dispersion is then mixed with the polyimide resin precursor solution.

One example of the method for dispersing a carbon black in a polyimide resin precursor solution will be explained. However, the method is not limited thereto.

At first, a carbon black and a small amount of a polyimide resin precursor solution are mixed with N-methyl-2-pyrrolidone, and the mixture is subjected to a dispersing treatment for a predetermined time using a dispersing machine such as ball mills, paint shakers and bead mills, which use zirconia beads as dispersing media. When the carbon black is dispersed so as to have a predetermined average particle diameter, the resultant dispersion is discharged from the dispersing machine. The thus prepared dispersion is mixed with the residue of the polyimide resin precursor solution so that the content of the carbon black in the mixture becomes the predetermined content. This mixing operation is performed using a machine such as centrifugal agitators, HENSCHEL MIXER mixers, homogenizers, and nauta mixing machines. If desired, other additives such as leveling agents and catalysts can be added to the mixture at this time. It is preferable to defoam the mixture after the mixing operation using a machine such as vacuum defoaming machines.

Next, the coating liquid applying/spreading process will be explained.

Specific examples of the methods for forming a polyimide resin precursor film include centrifugal molding, roll coating, blade coating, ring coating, dip coating, spray coating, dispenser coating and diecoating methods. Among these methods, centrifugal molding methods are typically used for forming a polyimide precursor film. However, by using the methods, the film is formed on the inner surface of a support. Therefore, when an outermost layer is formed on the outer surface of the film, the film has to be set on another support and the layer is formed on the outer surface of the set film. Therefore, the preparation method is complex.

Accordingly, in the present invention, roll coating, dispenser coating, ring coating and die coating methods are preferably used. Specifically, it is preferable that the coating liquid is coated on the outer surface of a support using one of these coating methods to form a substrate of the intermediate transfer belt, and then an outermost layer is formed on the substrate using the coating method.

It is more preferable to use the following method.

Specifically, a polyimide resin precursor solution is coated on an outer surface of a metal cylinder, on which a release agent is previously coated, and then the coated layer is dried using a dryer such as hot air dryers, IH heaters, and infrared heaters. This drying process is preferably performed such that at first, the coated layer is heated to a temperature ranging from 80 to 120° C., and then the layer is further heated to a temperature ranging from 300 to 400° C. at a temperature rising speed of from 2 to 5° C./min to perform an imidization reaction, i.e., to prepare a polyimide film. After the polyimide film is cooled, an outermost layer is formed on the polyimide film by a coating method. The coating method for forming the outermost layer is not necessarily the same as that for forming the polyimide film.

The thickness of the substrate (such as polyimide films) of the intermediate transfer belt of the present invention is preferably from 50 to 100 μm. When the substrate is too thin, the intermediate transfer belt has poor mechanical strength and the durability of the belt deteriorates. In contrast, when the substrate is too thick, the rigidity of the resultant intermediate transfer belt excessively increases, thereby causing a problem in that the belt cannot be driven by a driving roller having a small curvature.

The content of a carbon black serving as a resistivity controlling agent in the substrate is preferably from 5 to 25% by weight based on the total weight of substrate so that the volume resistivity of the substrate ranges from $10^6$ to $10^{10}$ C.·cm. When the content of carbon black is too low, it is difficult to control the volume resistivity of the substrate in the preferable range. In contrast, when the content is too high, the substrate becomes brittle (i.e., the flexibility of the substrate deteriorates), and thereby the durability of the substrate is deteriorated.

When the volume resistivity is too low, toner particles constituting a toner image on the intermediate transfer belt are scattered when the toner image is transferred, resulting in occurrence of a background development problem in that the background of an image is soiled with toner particles, resulting in deterioration of clearness of images. In contrast, when the volume resistivity is too high, the transfer bias applied to the intermediate transfer belt in an image transfer process cannot be well imparted thereto and thereby the image transfer efficiency cannot be improved. Therefore, it is not preferable.

Next, the outermost layer of the intermediate transfer belt, which is located overlying the substrate mentioned above, will be explained.

The outermost layer includes an epoxy-silicone copolymer. Epoxy-silicone copolymers have a good combination of dimensional stability, degradation resistance, and heat resistance. In addition, since epoxy-silicone copolymers have good adhesion to the above-mentioned substrate having good heat resistance, the outermost layer can be formed on the substrate without performing a primer treatment on the substrate. Further, since epoxy-silicone copolymers have appropriate flexibility, cracks are not formed in the outermost layer even when the intermediate transfer belt is bent. Furthermore, since epoxy-silicone copolymers have good cushionability, the resultant outermost layer can be well contacted with photoreceptors and receiving materials, and thereby toner images can be well transferred.

In addition, before crosslinking, epoxy-silicone copolymers typically have a liquid state. Therefore, methods similar to those mentioned above for use in preparing the substrate can be used for preparing the outermost layer. Namely, a continuous manufacturing method can be used for forming the intermediate transfer belt. Further, it is possible to add a solvent thereto to adjust the viscosity of the coating liquid. Furthermore, epoxy-silicone copolymers have good compatibility with various additives.

Epoxy-silicone copolymers for use in the outermost layer can be prepared by crosslinking one or more block copolymers having an epoxy unit and a silicone unit. Such block copolymers are prepared by subjecting an epoxy compound such as bisphenol A form diglycidyl ethers, and bisphenol F form diglycidyl ethers and a siloxane compound having a reactive group capable of reacting with an epoxy group of the epoxy compound (such as groups having an active hydrogen atom and precursors thereof) to alternating copolymerization. The block copolymers have an epoxy group at the end position thereof.

By incorporating a silicone unit, the resultant block copolymers have good flexibility, and therefore the outermost layer has good flexibility. As the content of the silicone unit increases, the flexibility of the layer is enhanced. However, when the content is too high, the layer has too low mechanical strength to be practically used. Therefore, the content of the silicone unit in the copolymer is preferably from 40 to 60% by weight.

The outermost layer is typically prepared by coating a coating liquid including such an epoxy-silicone copolymer and a known catalyst or crosslinking agent and then subjecting the coated layer to a heat crosslinking treatment. The temperature in the heat crosslinking treatment is preferably from 120 to 250° C. Therefore, the substrate on which the outermost layer is formed preferably has a high heat resistance. When a high heat resistant thermoplastic resin is used for forming the substrate, the substrate has to be formed by subjecting such a resin to melt molding at a temperature higher than the crosslinking temperature. Such a production method has poor productivity. Accordingly, in the present invention polyimide resins are used for the substrate as mentioned above.

Suitable crosslinking agents for use in crosslinking epoxy-silicone copolymers include compounds having an active hydrogen atom, and compounds which can be easily changed to such active hydrogen containing compounds by reacting with moisture in the air. For example, organic acids, acid anhydrides, amine compounds, phenolic compounds, silanol group containing compounds, or halogenated siloxane compounds, which form a silanol group by being hydrolyzed by moisture in the air, can be preferably used.

Specific examples of such acid anhydrides include tetrahydrophthalic anhydride, hexahydrophthalic anhydride, methyltetrahydrophthalic anhydride, methylhexahydrophthalic anhydride, methylnadic anhydride, hydrogenated methylnadic anhydride, trialkyltetrahydrophthalic anhydride, methylcyclohexenetetracarboxylic dianhydride, phthalic anhydride, trimellitic anhydride, pyromellitic anhydride, benzophenonetetracarboxylic dianhydride, ethyleneglycolbisanhydrotrimellite, glycerinbis(anhydrotrimellite) monoacetate, dodecenylsuccinic anhydride, polyanhydrides of dibasic fatty acids, and chlorendic anhydride.

Specific examples of the amine compounds for use as crosslinking agents include diethylenetriamine, triethylenetetramine, diethylaminopropylamine, N-aminoethylpiperazine, benzyldimethylamine, tris(dimethylaminomethyl)phenol, methaphenylenediamine, diaminophenylmethane, diaminodiphenylsulfone, polyamide resins, and imidazole compounds.

Among these compounds, imidazole compounds are preferably used. Specific examples of the imidazole compounds include 2-methylimidazole, 2-undecylimidazole, 2-heptadecylimidazole, 2-ethyl-4-methylimidazole, 2-phenylimidazole, 2-phenyl-4-methylimidazole, 1-cyanoethyl-2-methylimidazole, 1-cyanoethyl-2-ethyl-4-methylimidazole, 1-cyanoethyl-2-undecylimidazole, 1-cyanoethyl-2-phenylimidazole, 1-benzyl-2-methylimidazole, 1-benzyl-2-phenylimidazole, 2,4-diamino-6-[2'-methylimidazolyl-(1)']-ethyl-s-triazine, 2,4-diamino-6-[2'-undecylimidazolyl-(1)']-ethyl-s-triazine, 2,4-diamino-6-[2'-ethylimidazolyl-(1)']-ethyl-s-triazine, isocyanuric acid adduct of 2,4-diamino-6-[2'-methylimidazolyl-(1)']-ethyl-s-triazine, isocyanuric acid adduct of 2-methylimidazole, imidazole silane, etc.

Suitable phenolic compounds for use as crosslinking agents include novolak form phonolic resins, resole form phenolic resins, phenol-modified polyimide resins, etc.

These crosslinking agents can be used alone or in combination.

Among these crosslinking agents, liquid crosslinking agents can be preferably used because of being easily mixed with liquid epoxy-silicone resins. When solid crosslinking agents are used, it is preferable to use solutions of the agents prepared by dissolving the agents in a solvent. The added amount of a crosslinking agent is determined such that the equivalent weight of the reactive group of the crosslinking agent is the same as the equivalent weight of the epoxy groups of the epoxy-silicone copolymer used.

Similarly to the substrate, various additives (such as resistivity controlling agents) can be included in the outermost layer if desired. With respect to the resistivity controlling agent, the materials mentioned above for use in the substrate can also be used for the outermost layer. Among the materials, carbon black is preferably used. Carbon black can be well dispersed in epoxy-silicone copolymers, and therefore an outermost layer with small resistivity variation can be prepared.

When a resistivity controlling agent is mixed with an epoxy-silicone copolymer, both direct mixing methods and liquid mixing methods in which a solution or dispersion of the resistivity controlling agent is mixed with an epoxy-silicone copolymer can be used. However, when a solid resistivity controlling agent such as carbon black is used, the liquid mixing methods are preferably used.

The outermost layer preferably includes a particulate core-shell material having a silicone core and an acrylic shell to improve the transferability of the intermediate transfer belt. Such a particulate material is well dispersed in epoxy-silicone copolymers because the copolymers have an epoxy unit and a silicone unit. In order that the surface of the outermost layer has good surface smoothness and glossiness, the average particle diameter of the particulate material dispersed in the outermost layer is preferably not greater than 0.5 μm.

The outermost layer preferably includes a block copolymer including a fluorine-containing unit and an acrylic unit or a copolymer including a silicone unit and an acrylic unit because the properties of the surface of the outermost layer (such as releasability, slipping property, toner cleanability and abrasion resistance) can be enhanced.

Block copolymers including a fluorine-containing unit and an acrylic unit have a good releasability improving effect. Block copolymers including a silicone unit and an acrylic unit are preferably used for controlling the slipping property of the outermost layer.

These block copolymers can be used alone or in combination. These block copolymers have good affinity for epoxy-silicone copolymers because of having an acrylic unit, and can maintain the good affinity over a long period of time. In addition, the block copolymers do not unnecessarily cause a bleeding phenomenon from the outermost layer, and therefore the photoreceptors are hardly contaminated by the intermediate transfer belt.

One example of the methods for mixing a carbon black and a block copolymer including an acrylic unit and a fluorine-containing unit or a silicone unit will be explained.

At first, a carbon black and a small amount of a block copolymer are mixed, and the mixture is subjected to a dispersing treatment for a predetermined time using a dispersing machine such as ball mills, paint shakers and bead mills, which use zirconia beads as dispersing media. When the carbon black is dispersed so as to have a predetermined average particle diameter, the dispersion is discharged from the dispersing machine. The thus prepared dispersion is mixed with the residue of the block copolymer so that the content of the carbon black in the mixture becomes the predetermined content. Next, the predetermined amount of a crosslinking agent is added thereto. The mixing operation is performed using a machine such as centrifugal agitators, HENSCHEL MIXER mixers, homogenizers, and nauta mixing machines. If desired, other additives such as leveling agents and catalysts can be added to the mixture at this time. It is preferable to defoam the mixture after the mixing operation using a machine such as vacuum defoaming machines.

The thus prepared outermost layer coating liquid is coated on the substrate including a polyimide resin using a coating method similar to those mentioned above for use in preparing the substrate. The thickness of the (crosslinked) outermost layer is preferably from 50 to 300 μm. When the outermost layer is too thin, the layer has poor cushionability, i.e., the layer is not well contacted with photoreceptors and receiving materials. When the outermost layer is too thick, cracks tend to form in the layer if the intermediate transfer belt is bent by a driving roller and/or a tension roller.

The thus coated outermost layer is heated in a dryer to be crosslinked. The temperature of the heating treatment is determined depending on the properties of the crosslinking agent used, but is generally from 120 to 250° C. After the heating treatment, the belt is cooled and removed from the support. Thus, a seamless belt is prepared.

Hereinbefore, a two-layer intermediate transfer belt is explained, but the intermediate transfer belt of the present invention is not limited thereto. If desired, the intermediate transfer belt of the present invention can have three or more layers.

The thus prepared seamless belt is preferably used as an intermediate transfer belt of the image forming apparatus of the present invention. An example of the image forming apparatus of the present invention will be explained by reference to FIG. 1. However, the image forming apparatus of the present invention is not limited thereto.

The image forming apparatus illustrated in FIG. 1 has an intermediate transfer unit 500 including an intermediate transfer belt 501, which serves as an intermediate transfer medium and is tightly stretched by a plurality of rollers. Around the intermediate transfer belt 501, a secondary transfer bias roller 605 of a secondary transfer unit 600, which is configured to apply a secondary bias to the intermediate transfer belt 501, a belt cleaning blade 504 configured to clean the surface of the intermediate transfer belt 501, a lubricant applying brush 505 configured to apply a lubricant to the surface of the intermediate transfer belt 501, etc. are arranged so as to face the intermediate transfer belt 501.

In addition, a position detecting mark (not shown) is formed on an outer or inner surface of the intermediate transfer belt 501. When the position detecting mark is formed on the outer surface of the intermediate transfer belt 501, it is preferable that the mark is located at a position so as not to be contacted with the cleaning blade 504. If it is impossible, the mark is formed on an inner surface thereof. Referring to FIG. 1, an optical sensor 514, which serves as a sensor for detecting the position detecting mark, is arranged at a location between a primary bias roller 507 and a driving roller 508, which rollers support the intermediate transfer belt 501.

The intermediate transfer belt 501 is tightly stretched by the primary transfer bias roller 507, the driving roller 508, a tension roller 509, a secondary transfer counter roller 510, a cleaner counter roller 511 and a feedback current detecting roller 512. These rollers are formed of electroconductive materials, and all the rollers except for the primary bias roller 507 are grounded. A transfer bias, the current or voltage of which is adjusted on the basis of the number of the toner images overlaid on the intermediate transfer belt 501, is applied to the primary transfer bias roller 507 by a primary transfer power source 801, which is controlled so as to supply an electric power having a constant current or a constant voltage.

The intermediate transfer belt 501 is rotated by the driving roller 508 in a direction indicated by an arrow, wherein the driving roller 508 is driven by a driving motor (not shown). The intermediate transfer belt 501 is semiconductive or insulating and has a multi-layer structure. The above-mentioned intermediate transfer belt of the present invention is used for the intermediate transfer belt 501. Since the toner images formed on a photoreceptor 200 are transferred onto the intermediate transfer belt 501 while overlaid, the intermediate transfer belt has a width larger than that of largest sheets of the receiving material.

The secondary transfer bias roller 605 serving as a secondary transferring member is attached to or detached from the outer surface of the intermediate transfer belt 501 by an attaching and detaching mechanism, which will be explained later. The secondary transfer bias roller 605 is arranged such that a receiving material P is sandwiched by the secondary transfer bias roller 605 and a portion of the intermediate transfer belt 501 supported by the secondary transfer counter roller 510. A transfer bias with a predetermined current is applied to the secondary transfer bias roller 605 by a secondary transfer power source 802, which is controlled so as to supply an electric power with a constant current.

At a predetermined time, a pair of registration rollers 610 timely feeds a receiving paper P serving as a receiving material to a nip between the secondary transfer bias roller 605 and a portion of the intermediate transfer medium 501 supported by the secondary transfer counter roller 510. A cleaning blade 608 is arranged so as to contact the secondary transfer bias roller 605, to remove materials adhered to the surface thereof.

Next, the image forming operations of the image forming apparatus having such a construction as illustrated in FIG. 1 will be explained. When an image forming operation is started, the photoreceptor drum 200 is rotated by a driving motor (not shown) in a direction indicated by an arrow, and a black (K) toner image, a cyan (C) toner image, a magenta (M) toner image and a yellow (Y) toner image are formed one by one on the photoreceptor drum 200. The intermediate transfer belt 501 is rotated by the driving roller 508 in the direction indicated by the arrow. The K, C, M and Y toner images are transferred to the intermediate transfer belt 501 by the transfer bias applied to the primary transfer bias roller 507. Thus, the K, C, M and Y toner images are overlaid on the intermediate transfer belt 501 in this order. This transfer process is sometimes referred to as a primary transfer process. Numeral 513 denotes a toner image or an overlaid toner image Next, formation of the toner images will be explained. Referring to FIG. 1, a charger 203 performs corona discharging so that the photoreceptor has a predetermined negative potential. On the basis of a signal which is produced when the optical sensor 514 detects the position mark of the belt, raster light irradiation is timely performed on the thus charged photoreceptor 200 using a laser light beam L emitted by a light irradiator (not shown) and modulated according to the K image signal. Thereby the charges of portions of the photoreceptor exposed to the light beam are decayed so as to be proportional to the quantities of the light beam, resulting in formation of an electrostatic latent image corresponding to the K image on the photoreceptor drum 200. Numeral 204 denotes a potential sensor configured to measure the potential of the charged photoreceptor. When the thus prepared K latent image is contacted with a K toner which is located on a developing roller of a K developing device 231K in a developing unit 230 and which is negatively charged, the K toner is selectively adhered to the lighted portions because the toner is repulsed by the negatively charged portions (i.e., the non-irradiated portions) of the photoreceptor drum 200. Thus, a K toner image, which is the same as the K latent image, is formed on the photoreceptor drum 200. Numeral 205 denotes a toner image density sensor configured to measure the density of a toner image.

The K toner image thus formed on the photoreceptor drum 200 is then transferred (primary transfer) onto the outer surface of the intermediate transfer belt 501 which is rotated at the same speed as that of the photoreceptor drum 200 while contacted therewith. Toner particles remaining on the surface of the photoreceptor drum 200 even after the primary transfer process is removed by a photoreceptor cleaner 201. Thus, the photoreceptor drum 200 is ready for the next image formation.

On the other hand, similarly to formation of the K toner image, a cyan latent image is formed on the photoreceptor drum 200 by irradiating the photoreceptor drum, which is previously charged, with a laser light beam L modulated by cyan image data.

After the rear edge of the K latent image passes the developing unit 230 and before the front edge of the C latent image reaches the developing unit 230, the developing unit 230 is rotated so that a C developing device 231C takes the developing position. Then the C latent image is developed with the C developing device 231C using a C toner.

Similarly to the K and C toner image formation, a M toner image and a Y toner image are formed on the photoreceptor drum 200 using a M developing device 231M and a Y developing device 231Y while the developing unit 230 is rotated in a direction indicated by an arrow.

The K, C, M and Y toner images thus formed on the photoreceptor drum 200 are transferred one by one to proper positions of the intermediate transfer belt 501, resulting in formation of a combined color toner image including four color toner images at the most.

On the other hand, the receiving paper P, which is fed from a paper cassette or a manual paper-feeding tray, is stopped by the pair of the registration rollers 610. The receiving paper P is then timely fed along a guide plate 601 by the pair of registration rollers 610 so that the combined toner image on the intermediate transfer belt 501 is transferred to the predetermined position of the receiving paper P at the nip between the intermediate transfer belt 501 and the secondary transfer bias roller 605.

Thus, the toner image on the intermediate transfer belt 501 is transferred at the same time onto the receiving paper P by the transfer bias applied to the secondary transfer bias roller 605 by the secondary transfer power source 802. This transfer process is referred to as a secondary transfer process.

In this regard, plain papers having relatively smooth surface have been used as the receiving paper P. However, recently recycled papers and papers having relatively rough surface are used. In addition, other papers such as coat papers (for use in reproducing photographic images), and embossed papers having projected portions and recessed portions on the surface thereof are often used. When embossed papers are used, toner images cannot be well transferred to the recessed portions of the embossed papers by a conventional polyimide intermediate transfer belt, which tends to have a poor cushionability. Thus, image omissions or uneven color tone images are formed. By using the above-mentioned intermediate transfer belt of the present invention, occurrence of such problems can be prevented.

The receiving paper P, on which the toner image is transferred, is then fed along the guide plate 601 while discharged with a discharging device 606 having a discharging needle. The receiving paper P bearing the toner image thereon is then fed toward a fixing device 270 by a belt feeder 210. After the toner image is fixed on the receiving paper P at a nip formed by a fixing roller 271 and a pressure roller 272 of the fixing device 270, the receiving paper P bearing a fixed toner image thereon is discharged from the main body of the image forming apparatus and stacked on a copy tray (not shown). The fixing device 270 may be a fixing device having a fixing belt, and plural rollers such as combinations of a heat roller and a pressure roller.

On the other hand, the surface of the photoreceptor drum 200 is cleaned with the photoreceptor cleaner 201 and is then subjected to a discharge treatment using a discharge lamp 202. In addition, toner particles remaining on the outer surface of the intermediate transfer belt 501 are removed with the belt cleaner 504. The belt cleaner 504 can be attached to or detached from the outer surface of the intermediate transfer belt 501 by a cleaner attaching/detaching mechanism (not shown) at predetermined timing.

On an upstream side from the belt cleaner 504 relative to the rotating direction of the intermediate transfer belt 501, a toner sealing member 502 configured to receive the toner particles scraped off by the belt cleaner 504, resulting in prevention of the toner particles from being scattered on the receiving paper P. The toner sealing member 502 and the belt cleaner 504 are attached to or detached from the outer surface of the intermediate transfer belt 501 by the cleaner attaching/detaching mechanism. Numeral 503 denotes a charger.

The thus cleaned surface of the intermediate transfer belt 501 is supplied with a lubricant by the brush 505, which scrapes off the surface of a lubricant 506. Suitable materials for use as the lubricant 506 include solid lubricants such as zinc stearate. The lubricant applicator is configured to maintain good transfer property and cleaning property of the intermediate transfer belt over along period of time. However, it is not necessarily provided depending on the properties of the intermediate transfer belt used.

Charges remaining on the intermediate transfer belt 501 are removed by a discharge bias applied by a discharge brush (not shown). The brush 505 and the discharge brush are attached to or detached from the outer surface of the intermediate transfer belt 501 by respective attaching/detaching mechanisms (not shown).

When plural copies are produced, a first color (K) image forming operation for the second copy image is started at a predetermined time after the fourth color (Y) image forming operation for the first copy image is completed. On the other hand, the intermediate transfer belt 501 is cleaned with the belt cleaner 504 after the secondary transfer process of the first image. The K toner image of the second image is then transferred (primary transfer) to the predetermined position of the thus cleaned intermediate transfer belt 501. Next, C, M and Y toner images for the second copy image are similarly formed and transferred on the predetermined position of the intermediate transfer belt 501 bearing the K toner image thereon. In FIG. 1, numerals 70 and 80 denote a discharge roller configured to discharge the residual charges of the intermediate transfer belt, and a ground roller.

Hereinbefore, formation of a full color image including four color toner images is described. However, a multi-color image including three color toner images or two color toner images can also be prepared by forming the predetermined color toner images using the image forming method mentioned above. When a mono-color image is prepared, the developing operation is performed while the predetermined developing device (231K, Y, M or C) of the revolver developing unit 230 is staying at the developing position until the predetermined number of copies are produced and the belt cleaner is contacting the intermediate transfer belt 501.

The above-mentioned example of the image forming apparatus has only one photoreceptor drum. However, image forming apparatus of the present invention is not limited thereto. For example, a tandem type image forming apparatus, in which a plurality of photoreceptor drums are serially arranged along an intermediate transfer medium as illustrated in FIG. 2, can also be used.

Figure 2:
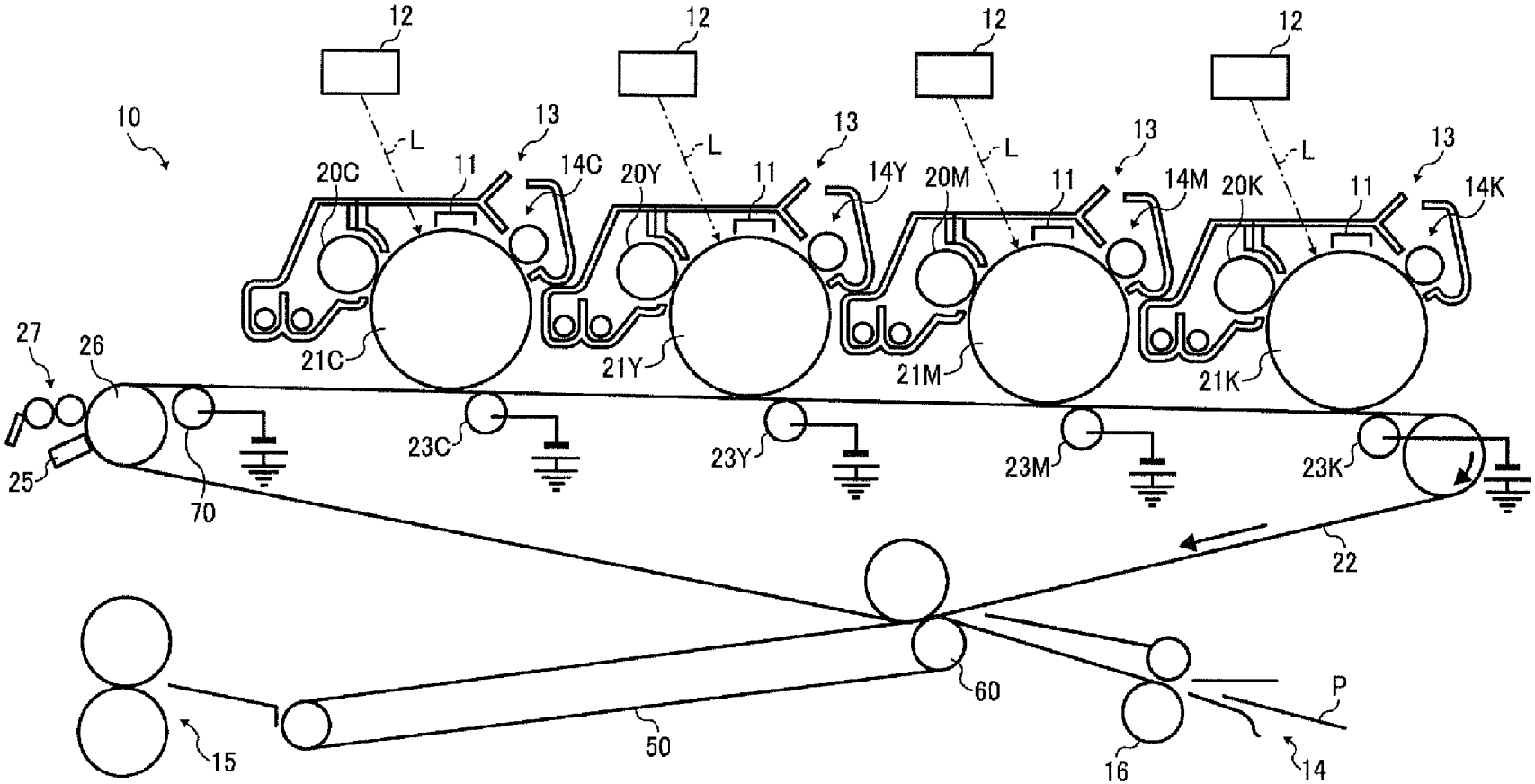
FIG. 2 is a schematic view illustrating another example of the electrophotographic image forming apparatus of the present invention.

FIG. 2 is a schematic view illustrating a digital color printer having four photoreceptor drums 21K, 21M, 21Y and 21C configured to bear K, M, Y and C toner images, respectively.

The color printer includes a main body 10 as illustrated in FIG. 2. The main body 10 includes an image writing device 12, which emits imagewise laser light, image forming sections 13 and a paper feeding section 14. Image signals for K, M, Y and C color images, which are produced by an image processor on the basis of the original color image signals, are sent to the image writing device 12. The image writing device 12 is a laser scanning optical device including, for example, a laser light source, a deflector such as polygon mirrors, a scanning focusing optical device, and a group of mirrors. The writing device 12 has four light passages through which light irradiation is performed on the respective photoreceptor drums 21K, 21M, 21Y and 21C to form K, M, Y and C latent images thereon.

The image forming section 13 includes four photoreceptor drums 21K, 21M, 21Y and 21C for K, M, Y and C color image formation, respectively. In this regard, organic photoconductors are typically used for the photoreceptor drums. Around each of the photoreceptor drums, a charger 11 configured to charge the photoreceptor, the image writing device 12 configured to irradiate the photoreceptor with laser beams L, a developing device 20K, 20M, 20Y or 20C, a primary transfer bias roller 23K, 23M, 23Y or 23C, a cleaner 14K, 14M, 14Y or 14C, and other devices such as a discharger are arranged. The developing device 20 uses a two component magnet brush developing method. An intermediate transfer belt 22, which is the intermediate transfer belt of the present invention, is located between the photoreceptor drum 21 and the primary bias roller 23. Black (K), magenta (M), yellow (Y) and cyan (C) color toner images formed on the photoreceptor drums 21 are sequentially transferred to the intermediate transfer belt 22.

The receiving paper P fed from the paper feeding section 14 is fed by a pair of registration roller 16 and then held by a feeding belt 50. The toner images formed on the intermediate transfer belt 22 are secondarily transferred to the receiving paper P by a secondary transfer bias roller 60 at a point in which the intermediate transfer belt 22 is contacted with the feeding belt 50. Thus, a combined color toner image is formed on the receiving paper P. The receiving paper P bearing the combined color toner image thereon is fed to a fixing device 15 by the feeding belt 50, and the combined color toner image is fixed on the receiving paper P, resulting in formation of a full color image. The receiving paper P bearing the full color image thereon is then discharged from the main body 10.

Toner particles remaining on the surface of the intermediate transfer belt 22 even after the secondary transfer process are removed by a belt cleaner 25. On a downstream side from the belt cleaner 25 relative to the rotation direction of the intermediate transfer belt 22, a lubricant applicator 27 is provided. The lubricant applicator 27 includes a solid lubricant and an electroconductive brush configured to apply the lubricant to the surface of the intermediate transfer belt 22 while rubbing the intermediate transfer belt 22. By applying a lubricant to the surface of the intermediate transfer belt 22, the cleanability of the belt 22 can be improved and thereby formation of a toner film on the belt 22 can be prevented, resulting in prolongation of the life of the belt 22.

The image forming apparatus of the present invention is not limited to the image forming apparatus using the intermediate transfer belt 501 or 22, and image forming apparatus using a feeding belt configured to feed a receiving material instead of the intermediate transfer belt can also be used. For example, toner images formed on one or more photoreceptors are directly transferred onto a receiving material fed by such a feeding belt to form a monochrome image or a multicolor (or full color) image.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(1) Preparation of Intermediate Transfer Belt A

1) Preparation of Coating Liquid for Substrate

The following components were mixed.

| | |
|---|---|
| Polyimide varnish (U-VARNISH A from Ube Industries, Ltd., solid content of 18% by weight) | 2 parts |
| Carbon black (SPECIAL BLACK 4 from Degussa A.G.) | 10 parts |
| N-Methyl-2-pyrrolidone (from Mitsubishi Chemical Corp.) | 88 parts |

The mixture was subjected to a dispersing treatment for 5 hours using a bead mill containing zirconia beads having a diameter of 1 mm to prepare a carbon black dispersion.

Next, the following components were mixed.

| | |
|---|---|
| Above-prepared carbon black dispersion | 50 parts |
| Polyimide varnish (U-VARNISH A from Ube Industries, Ltd., solid content of 18% by weight) | 50 parts |
| Polyether-modified silicone (FZ2105 from Dow Corning Toray Silicone Co., Ltd.) | 0.01 parts |

The mixture was then mixed while defoamed using a centrifugal agitating/defoaming machine. Thus, a coating liquid for the substrate was prepared.

2) Preparation of Substrate

A substrate was prepared using the above-prepared coating liquid and a metal cylinder serving as a die, which has an outer diameter of 100 mm and a length of 300 mm and has a mirrored outer surface on which a release agent is coated. Specifically, the above-prepared coating liquid was evenly spread on the outer surface of the cylinder with a dispenser while rotating the cylinder at 50 rpm (revolution per minute). In this regard, the flow rate of the coating liquid was controlled so that the resultant (dried) substrate has a thickness of 70 μm. After all the coating liquid was evenly spread, the cylinder bearing the coated liquid thereon was set in a hot air circulating dryer while rotated. The dryer was heated to 100° C. at a temperature rising speed of 3° C./min, and the cylinder was heated for 30 minutes at 100° C. while rotated. After rotation of the cylinder was stopped, the cylinder bearing a layer thereon was set in a furnace, which was heated to 310° C. at a temperature rising speed of 2° C./min. The cylinder was heated for 60 minutes at 310° C., followed by cooling to room temperature. Thus, a substrate of the intermediate transfer belt was prepared.

3) Preparation of Outermost Layer Coating Liquid A

The following components were mixed.

| | |
|---|---|
| Epoxy-silicone copolymer (ALBIFLEX 296 from Nanoresins Co., silicone content of 60% by weight) | 1 part |
| Carbon black (SPECIAL BLACK 4 from Degussa A.G.) | 10 parts |
| N-Methyl-2-pyrrolidone (from Mitsubishi Chemical Corp.) | 89 parts |

The mixture was subjected to a dispersing treatment for 5 hours using a bead mill containing zirconia beads having a diameter of 1 mm to prepare a carbon black dispersion A.

Next, the following components were mixed.

| | |
|---|---|
| Above-prepared carbon black dispersion A | 52 parts |
| Epoxy-silicone copolymer (ALBIFLEX 296 from Nanoresins Co., silicone content of 60% by weight) | 40 parts |
| Methyltetrahydrophthalic anhydride (HN-2000 from Hitachi Chemical Co., Ltd.) | 8 parts |

The mixture was then mixed while defoamed using a centrifugal agitating/defoaming machine. Thus, an outermost layer coating liquid A was prepared.

4) Preparation of Outermost Layer A

The above-prepared outermost layer coating liquid A was evenly spread on the substrate on the cylinder with a dispenser while rotating the cylinder at 50 rpm (revolution per minute) In this regard, the flow rate of the coating liquid was controlled so that the resultant (dried) outermost layer has a thickness of 200 μm. After all the coating liquid was evenly spread, the cylinder bearing the coated liquid thereon was set in a hot air circulating dryer while rotated. The dryer was heated to 120° C. at a temperature rising speed of 4° C./min, and the cylinder was heated for 30 minutes at 120° C. while rotated. In addition, the cylinder was heated to 250° C. at a temperature rising speed of 4° C./min. The cylinder was heated for 120 minutes at 250° C., followed by cooling to room temperature. The film formed on the cylinder was removed therefrom. Thus, a seamless belt A was prepared.

Example 2

The procedure for preparation of the seamless belt A in Example 1 was repeated except that the outermost layer coating liquid A was replaced with an outermost layer coating liquid B, which was prepared as follows.

1) Preparation of Outermost Layer Coating Liquid B

The following components were mixed.

| | |
|---|---|
| Epoxy-silicone copolymer (ALBIFLEX 348 from Nanoresins Co., silicone content of 60% by weight) | 1 part |
| Carbon black (SPECIAL BLACK 4 from Degussa A.G.) | 10 parts |
| Particulate core-shell material (GENIOPEARL P52 from Wacker Asahikasei Silicone Co., Ltd., having a silicone rubber core and a polymethyl methacrylate shell) | 10 parts |
| Methyl ethyl ketone (from Mitsubishi Chemical Corp.) | 79 parts |

The mixture was subjected to a dispersing treatment for 5 hours using a bead mill containing zirconia beads having a diameter of 1 mm to prepare a carbon black dispersion B.

Next, the following components were mixed.

| | |
|---|---|
| Above-prepared carbon black dispersion B | 54 parts |
| Epoxy-silicone copolymer (ALBIFLEX 348 from Nanoresins Co., silicone content of 60% by weight) | 40 parts |
| Methyltetrahydrophthalic anhydride (HN-2000 from Hitachi Chemical Co., Ltd.) | 6 parts |

The mixture was then mixed while defoamed using a centrifugal agitating/defoaming machine. Thus, an outermost layer coating liquid B was prepared.

Thus, a seamless belt B was prepared.

Example 3

The procedure for preparation of the seamless belt A in Example 1 was repeated except that the outermost layer coating liquid A was replaced with an outermost layer coating liquid C, which was prepared as follows.

1) Preparation of Outermost Layer Coating Liquid C

The following components were mixed.

| | |
|---|---|
| Epoxy-silicone copolymer (ALBIFLEX 348 from Nanoresins Co., silicone content of 60% by weight) | 1 part |
| Carbon black (MA100R from Mitsubishi Chemical Corp.) | 10 parts |
| Particulate core-shell material (GENIOPEARL P52 from Wacker Asahikasei Silicone Co., Ltd., having a silicone rubber core and a polymethyl methacrylate shell) | 10 parts |
| Methyl ethyl ketone (from Mitsubishi Chemical Corp.) | 79 parts |

The mixture was subjected to a dispersing treatment for 5 hours using a bead mill containing zirconia beads having a diameter of 1 mm to prepare a carbon black dispersion C.

Next, the following components were mixed.

| | |
|---|---|
| Above-prepared carbon black dispersion C | 59 parts |
| Epoxy-silicone copolymer (ALBIFLEX 348 from Nanoresins Co., silicone content of 60% by weight) | 36 parts |
| Methyltetrahydrophthalic anhydride (HN-2000 from Hitachi Chemical Co., Ltd.) | 5 parts |

The mixture was then mixed white defoamed using a centrifugal agitating/defoaming machine. Thus, an outermost layer coating liquid C was prepared.

Thus, a seamless belt C was prepared.

Example 4

The procedure for preparation of the seamless belt A in Example 1 was repeated except that the outermost layer coating liquid A was replaced with an outermost layer coating liquid D, which was prepared as follows.

1) Preparation of Outermost Layer Coating Liquid D

The following components were mixed.

| | |
|---|---|
| Epoxy-silicone copolymer (ALBIFLEX 348 from Nanoresins Co., silicone content of 60% by weight) | 1 part |
| Carbon black (MA100R from Mitsubishi Chemical Corp.) | 10 parts |
| Particulate core-shell material (GENIOPEARL P52 from Wacker Asahikasei Silicone Co., Ltd., having a silicone rubber core and a polymethyl methacrylate shell) | 10 parts |
| Methyl ethyl ketone (from Mitsubishi Chemical Corp.) | 79 parts |

The mixture was subjected to a dispersing treatment for 5 hours using a bead mill containing zirconia beads having a diameter of 1 mm to prepare a carbon black dispersion D.

Next, the following components were mixed.

| | |
|---|---|
| Above-prepared carbon black dispersion D | 59 parts |
| Epoxy-silicone copolymer (ALBIFLEX 348 from Nanoresins Co., silicone content of 60% by weight) | 36 parts |
| Imidazole crosslinking agent (CUREZOL 2E4MZ from Shikoku Chemicals Corp.) | 4 parts |

The mixture was then mixed while defoamed using a centrifugal agitating/defoaming machine. Thus, an outermost layer coating liquid D was prepared.

The above-prepared outermost layer coating liquid D was evenly spread on the substrate on the cylinder with a dispenser while rotating the cylinder at 50 rpm (revolution per minute) In this regard, the flow rate of the coating liquid was controlled so that the resultant (dried) outermost layer has a thickness of 200 μm. After all the coating liquid was evenly spread, the cylinder bearing the coated liquid thereon was set in a hot air circulating dryer while rotated. The dryer was heated to 150° C. at a temperature rising speed of 5° C./min, and the cylinder was heated for 4 hours at 150° C. while rotated. After the heat treatment, the cylinder was cooled to room temperature. The film formed on the cylinder was removed therefrom.

Thus, a seamless belt D was prepared.

Example 5

The procedure for preparation of the seamless belt D in Example 4 was repeated except that the outermost layer coating liquid D was replaced with the following outermost layer coating liquid E.

1) Preparation of Outermost Layer Coating Liquid E

The following components were mixed.

| | |
|---|---|
| Epoxy-silicone copolymer (ALBIFLEX 348 from Nanoresins Co., silicone content of 60% by weight) | 1 part |
| Carbon black (MA100R from Mitsubishi Chemical Corp.) | 10 parts |
| Particulate core-shell material (GENIOPEARL P52 from Wacker Asahikasei Silicone Co., Ltd., having a silicone rubber core and a polymethyl methacrylate shell) | 10 parts |
| Methyl ethyl ketone (from Mitsubishi Chemical Corp.) | 79 parts |

The mixture was subjected to a dispersing treatment for 5 hours using a bead mill containing zirconia beads having a diameter of 1 mm to prepare a carbon black dispersion E.

Next, the following components were mixed.

| | |
|---|---|
| Above-prepared carbon black dispersion E | 57 parts |
| Epoxy-silicone copolymer (ALBIFLEX 348 from Nanoresins Co., silicone content of 60% by weight) | 36 parts |
| Imidazole crosslinking agent (CUREZOL 2E4MZ from Shikoku Chemicals Corp.) | 4 parts |
| Block copolymer including an acrylic unit and fluorine-contained unit (MODIPER F600 from NOF Corp.) | 3 parts |

Thus, a seamless belt E was prepared.

Example 6

The procedure for preparation of the seamless belt D in Example 4 was repeated except that the outermost layer coating liquid ID was replaced with the following outermost layer coating liquid F.

1) Preparation of Outermost Layer Coating Liquid F

The following components were mixed.

| | |
|---|---|
| Epoxy-silicone copolymer (ALBIFLEX 348 from Nanoresins Co., silicone content of 60% by weight) | 1 part |
| Carbon black (MA100R from Mitsubishi Chemical Corp.) | 10 parts |
| Particulate core-shell material (GENIOPEARL P52 from Wacker Asahikasei Silicone Co., Ltd., having a silicone rubber core and a polymethyl methacrylate shell) | 10 parts |
| Methyl ethyl ketone (from Mitsubishi Chemical Corp.) | 79 parts |

The mixture was subjected to a dispersing treatment for 5 hours using a bead mill containing zirconia beads having a diameter of 1 mm to prepare a carbon black dispersion F.

Next, the following components were mixed.

| | |
|---|---|
| Above-prepared carbon black dispersion F | 52 parts |
| Epoxy-silicone copolymer (ALBIFLEX 348 from Nanoresins Co., silicone content of 60% by weight) | 35 parts |
| Imidazole crosslinking agent (CUREZOL 2E4MZ from Shikoku Chemicals Corp.) | 3 parts |
| Block copolymer including acrylic unit and silicone unit (MODIPER S700 from NOF Corp.) | 10 parts |

Thus, a seamless belt F was prepared.

Comparative Example 1

The procedure for preparation of the seamless belt A in Example 1 was repeated except that the outermost layer was not formed on the substrate.

Thus, a comparative seamless belt G consisting of the polyimide substrate was prepared.

Evaluation of Seamless Belts

Each of the above-prepared seamless belts was set in an image forming apparatus having the structure as illustrated in FIG. 2, and blue color solid images consisting of a cyan image and a magenta image were formed on sheets of a rough Japan paper (SAZANAMI FC JAPAN PAPER from Ricoh Co., Ltd.), which has appearance like Japan paper and has a smoothness of 5 seconds. The thus formed blue color images were visually observed to determined whether or not the color tone of the images is uniform.

The results are shown in Table 1

| | Intermediate transfer belt | Quality of blue color solid image |
|---|---|---|
| Ex. 1 | A | The color tone is uniform, but is slightly reddish. |
| Ex. 2 | B | The color tone is uniform, but is slightly reddish. |
| Ex. 3 | C | The color tone is uniform, but is very slightly reddish. |
| Ex. 4 | D | The color tone is uniform, but is very slightly reddish. |
| Ex. 5 | E | Good (i.e., uniform blue color image) |
| Ex. 6 | F | Good (i.e., uniform blue color image) |
| Comp. Ex. 1 | G | Only the magenta image is transferred onto a recessed portion of the paper. Namely, the image has blue color portions and magenta color portions. |

It is clear from Table 1 that by forming an outermost layer of the present invention, toner images can be well transferred to a rough paper. In addition, it is clear that by adding a particulate material having a silicone core and an acrylic shell to the outermost layer, the toner images can be well transferred and thereby toner images with good color reproducibility can be formed. Further, by adding a silicone-acrylic copolymer to the outermost layer, the color reproducibility of the resultant images can be further enhanced.

Example 7

The procedure for preparation of the seamless belt F in Example 6 was repeated except that the substrate was replaced with the following substrate, which was prepared as follows.

1) Preparation of Coating Liquid for Substrate

The following components were mixed.

| | |
|---|---|
| Polyamideimide varnish (HR16NN from Toyobo Co., Ltd., solid content of 15% by weight) | 2 parts |
| Carbon black (MA100R from Mitsubishi Chemical Corp.) | 10 parts |
| N-Methyl-2-pyrrolidone (from Mitsubishi Chemical Corp.) | 88 parts |

The mixture was subjected to a dispersing treatment for 5 hours using a bead mill containing zirconia beads having a diameter of 1 mm to prepare a carbon black dispersion.

Next, the following components were mixed.

| | |
|---|---|
| Above-prepared carbon black dispersion | 50 parts |
| Polyamideimide varnish (HR16NN from Toyobo Co., Ltd., solid content of 15% by weight) | 50 parts |
| Polyether-modified silicone (FZ2105 from Dow Corning Toray Silicone Co., Ltd.) | 0.01 parts |

The mixture was then mixed while defoamed using a centrifugal agitating/defoaming machine. Thus, a coating liquid for the substrate was prepared.

2) Preparation of Substrate

A substrate was prepared using the above-prepared coating liquid and a metal cylinder serving as a die, which has an outer diameter of 100 mm and a length of 300 mm and has a mirrored outer surface on which a release agent is coated. Specifically, the above-prepared coating liquid was evenly spread on the outer surface of the cylinder with a dispenser while rotating the cylinder at 50 rpm (revolution per minute). In this regard, the flow rate of the coating liquid was controlled so that the resultant (dried) substrate has a thickness of 70 μm. After all the coating liquid was evenly spread, the cylinder bearing the coated liquid thereon was set in a hot air circulating dryer while rotated. The dryer was heated to 100° C. at a temperature rising speed of 3° C./min, and the cylinder was heated for 30 minutes at 100° C. while rotated. After rotation of the cylinder was stopped, the cylinder bearing a layer thereon was set in a furnace, which was heated to 260° C. at a temperature rising speed of 2° C./min. Thus, the cylinder was heated for 60 minutes at 260° C., followed by cooling to room temperature. Thus, a substrate of the intermediate transfer belt was prepared.

Thus, a seamless belt H was prepared.

Comparative Example 2

A silicone primer was coated on the surface of the substrate on the substrate prepared in Example 7, and the following outermost layer was formed thereon.

1) Preparation of Outermost Layer Coating Liquid

The following components were mixed.

| | |
|---|---|
| Addition reaction type two-component thermosetting liquid silicone rubber (ELASTOSIL LR3303/60 from Wacker Asahikasei Silicone Co., Ltd., two liquids were mixed in a weight ratio of 1/1) | 85 parts |
| Carbon black (VULCAN XC72 from Cabot Corp.) | 5 parts |

The mixture was well kneaded by a three-roll mill to prepare an outermost layer coating liquid.

2) Preparation of Outermost Layer

The above-prepared outermost layer coating liquid was coated on the substrate subjected to the primer treatment, followed by crosslinking for 20 minutes at 80° C. Thus, an outermost layer with a thickness of 200 μm was prepared.

Thus, a comparative seamless belt I was prepared.

Comparative Example 3

The procedure for preparation of the seamless belt H in Example 7 was repeated except that the outermost layer was not formed on the polyamideimide substrate.

Thus, a comparative seamless belt J was prepared.

Evaluation of Seamless Belts F, H, I and J

The evaluation method mentioned above was repeated. In addition, a running test, in which 10,000 copies of a half-tone image are continuously produced, was performed. The first copy and the 10,000$^{th}$ copy of the half-tone image were visually observed to evaluate the image qualities.

The results are shown in Table 2.

| | Intermediate transfer belt | Quality of blue solid image | Quality of half tone image: First copy | Quality of half tone image: 10,000$^{th}$ copy |
|---|---|---|---|---|
| Ex. 6 | F | Good (even blue image) | Good | Good |
| Ex. 7 | H | Good (even blue image) | Good | An image omission is formed on a portion (due to formation of cracks in the substrate) |
| Comp. Ex. 2 | I | Some uneven color tone portions are present. | Some uneven color tone portions are present. | A number of uneven density portions are present. |
| Comp. Ex. 3 | J | Only the magenta image is transferred onto recessed portions of the receiving paper. Namely, the image has blue color portions and magenta color portions. | A number of image omissions are formed on recessed portions of the receiving paper. | The belt was severed before production of the 10000$^{th}$ image. |

It is clear from Table 2 that by using a polyimide resin for the substrate, the resultant intermediate transfer belt can produce high quality images over a long period of time. The intermediate transfer belt of the present invention using a polyimide resin for the substrate can produce high quality half tone images over a long period of time because the resistance of the outermost layer is uniform.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2008-035519 and 2008-290989, filed on Feb. 18, 2008, and Nov. 13, 2008, respectively, the entire contents of which are herein incorporated by reference.

What is claimed is:

1. An intermediate transfer belt, which receives plural color toner images from one or more latent image bearing members and then transfers the plural color toner images onto a receiving material, wherein the intermediate transfer belt comprises:

a substrate; and an outermost layer located overlying the substrate and including an epoxy-silicone copolymer.

2. The intermediate transfer belt according to claim 1, wherein the substrate includes a polyimide resin.

3. An intermediate transfer belt, which receives plural color toner images from one or more image bearing members and then transfers the plural color toner images onto a receiving material, wherein the intermediate transfer belt comprises:

a substrate; and an outermost layer located overlying the substrate and including an epoxy-silicone copolymer, wherein the epoxy-silicone copolymer includes a silicone unit in an amount of from 40 to 60% by weight.

4. An intermediate transfer belt, which receives plural color toner images from one or more image bearing members and then transfers the plural color toner images onto a receiving material, wherein the intermediate transfer belt comprises:

a substrate; and an outermost layer located overlying the substrate and including an epoxy-silicone copolymer, wherein the outermost layer further includes a particulate core-shell material including a silicone core and an acrylic shell.

5. The intermediate transfer belt according to claim 1, wherein the outermost layer further includes at least one member selected from the group consisting of block copolymers including a fluorine-containing unit and an acrylic unit and block copolymers including a silicone unit and an acrylic unit.

6. An image forming apparatus comprising:

at least one latent image bearing member configured to bear plural color toner images thereon;

a primary transfer device including:

the intermediate transfer belt according to claim 1, wherein the primary transfer device transfers the plural color toner images from the at least one latent image bearing member to the intermediate transfer belt to form a combined color toner image thereon; and a secondary transfer device configured to transfer the combined color toner image onto a receiving material.

7. An image forming apparatus comprising:

at least one image hearing member configured to hear plural color toner images thereon;

a primary transfer device including:

the intermediate transfer belt according to claim 3, wherein the primary transfer device transfers the plural color toner images from the at least one image bearing member to the intermediate transfer belt to form a combined color toner image thereon, and a secondary transfer device configured to transfer the combined color toner image onto a receiving material.

8. An image forming apparatus comprising:

at least one image bearing member configured to bear plural color toner images thereon;

a primary transfer device including:

the intermediate transfer belt according to claim 4, wherein the primary transfer device transfers the plural color toner images from the at least one image bearing member to the intermediate transfer belt to form a combined color toner image thereon, and a secondary transfer device configured to transfer the combined color toner image onto a receiving material.

9. The intermediate transfer hell according to claim 1, wherein the epoxy-silicone copolymer is prepared by cross-linking one or more block copolymers having an epoxy unit and a silicone unit.

* * * * *